US012104877B2

(12) United States Patent
Liu

(10) Patent No.: US 12,104,877 B2
(45) **Date of Patent: *Oct. 1, 2024**

(54) CROSSBOW WITH REPLACEABLE BOW UNIT

(71) Applicant: Chi-Chang Liu, Taichung (TW)

(72) Inventor: Chi-Chang Liu, Taichung (TW)

(73) Assignee: POE LANG ENTERPRISE CO., LTD., Taichung (TW)

( * ) Notice: Subject to any disclaimer, the term of this patent is extended or adjusted under 35 U.S.C. 154(b) by 84 days.

This patent is subject to a terminal disclaimer.

(21) Appl. No.: 17/899,629

(22) Filed: Aug. 31, 2022

(65) Prior Publication Data

US 2023/0332859 A1 Oct. 19, 2023

Related U.S. Application Data

(63) Continuation-in-part of application No. 17/723,478, filed on Apr. 19, 2022, now Pat. No. 11,761,728.

(51) Int. Cl.
*F41B 5/12* (2006.01)
*F41A 9/61* (2006.01)

(52) U.S. Cl.
CPC ..... *F41B 5/126* (2013.01); *F41A 9/61* (2013.01)

(58) Field of Classification Search
CPC .... F41B 5/126; F41B 5/00; F41B 5/12; F41B 5/123; F41B 11/50; F41B 11/55; A41A 9/61
USPC ..... 124/45, 49, 25.5, 25.7
See application file for complete search history.

(56) References Cited

U.S. PATENT DOCUMENTS

| | | | | |
|---|---|---|---|---|
| 2,516,341 | A * | 7/1950 | Raffeis | F41B 5/12 124/35.1 |
| 3,125,998 | A * | 3/1964 | Stevens | F41B 5/126 125/41 |
| 3,670,711 | A * | 6/1972 | Firestone | F41B 5/12 124/35.1 |
| 5,215,069 | A * | 6/1993 | Liu | F41B 5/12 124/40 |
| 5,544,641 | A * | 8/1996 | Jenn | F41G 1/467 124/52 |
| 6,273,079 | B1 * | 8/2001 | Jzn | F41B 11/52 124/45 |
| 6,868,845 | B1 * | 3/2005 | Moore | F41B 5/10 124/25 |
| 9,644,919 | B1 * | 5/2017 | Liu | F41B 5/12 |
| 9,689,639 | B1 * | 6/2017 | Liu | F16B 21/06 |
| 11,268,782 | B1 * | 3/2022 | Chang | F41B 5/12 |

(Continued)

*Primary Examiner* — John E Simms, Jr.
(74) *Attorney, Agent, or Firm* — Ying-Ting Chen

(57) ABSTRACT

A crossbow includes a body having a grip and a connection end respectively formed to two ends of the body. A connection part is formed to the connection end and includes a clamping portion and a top portion. The top portion includes a guide face firmed to the top thereof. A bow unit includes a bow and a block which is formed to middle portion of the bow. A string is connected between two ends of the bow. The block is detachably connected to the clamping portion to transversely position the string above the guide face. A magazine includes a mounting member located corresponding to the clamping portion. The magazine is detachably connected to the body to form a room between the guide face and the magazine for movement of the string. The magazine is secured to the body by the mounting member.

8 Claims, 9 Drawing Sheets

(56) References Cited

U.S. PATENT DOCUMENTS

| | | | | |
|---|---|---|---|---|
| 11,761,728 | B2 * | 9/2023 | Liu | F41B 5/0026 124/25 |
| 2006/0169259 | A1 * | 8/2006 | Chang | F41B 5/1426 124/25 |
| 2009/0178658 | A1 * | 7/2009 | Barnett | F41B 5/12 124/25 |
| 2014/0283805 | A1 * | 9/2014 | Dunlop | F41B 5/1469 124/25 |
| 2017/0122693 | A1 * | 5/2017 | Chu | F41B 5/1403 |
| 2020/0191518 | A1 * | 6/2020 | Egerdee | F41B 5/1403 |
| 2020/0300575 | A1 * | 9/2020 | Zuo | A63H 33/18 |
| 2022/0364820 | A1 * | 11/2022 | Barnett | F41B 5/1461 |
| 2022/0412687 | A1 * | 12/2022 | Liu | F41B 5/126 |
| 2023/0235988 | A1 * | 7/2023 | Liu | F41B 5/126 124/25 |

* cited by examiner

CROSSBOW WITH REPLACEABLE BOW UNIT

The present invention is a Continuation-In-Part of applicant's former patent application with application Ser. No. 17/723,478, filed on Apr. 19, 2022. This CIP claims priority of CN 11103334, filed on Jan. 26, 2022, the entire contents of which are hereby incorporated by reference.

BACKGROUND OF THE INVENTION

1. Fields of the Invention

2. Descriptions of Related Art

The conventional crossbow known to applicant is disclosed in Taiwanese Publication No. 1724942 and includes a magazine which is connected to the top of the crossbow to provide arrows into the flight groove one by one, such that the user does not need to put the crossbow down and reload a new arrow. The magazine includes a retainer which provide a downward force to the arrows in the magazine so that the arrow can be loaded in the flight groove of the crossbow one by one.

When loading arrows into the magazine, a retainer is pivoted upward about one end, so that the hook-end formed to the other end of the retainer is removed from the flight groove. Arrows are then loaded into the magazine, and the retainer is pivoted downward again to press the arrows.

It is noted that the hook-end of the retainer has to be positioned above the flight groove before loading the arrows, and the hook-end of the retainer is pivoted back into the flight groove. This operation takes time. Besides, the magazine is fixed to the crossbow, so that when loading arrows, the user has to support the weight of the whole crossbow.

The present invention intends to provide a crossbow with a replaceable bow unit and a replaceable magazine, so as to eliminate the shortcomings mentioned above.

SUMMARY OF THE INVENTION

The present invention relates to a crossbow and comprises a body having a grip and a connection end respectively formed to two ends of the body. A connection part is formed to the connection end and includes a clamping portion and a top portion. The clamping portion is formed with the top portion. The top portion includes a guide face firmed to the top thereof. A bow unit includes a bow and a block which is formed to the middle portion of the bow. A string is connected between two ends of the bow. The block is detachably connected to the clamping portion to transversely position the string above the guide face. A magazine includes a mounting member which is located corresponding to the clamping portion. The magazine is detachably connected to the body to form a room between the guide face and the magazine so that the string is movable along the room. The magazine is secured to the body by the mounting member.

The present invention provides a crossbow that the magazine can be easily and conveniently detached from the body of the crossbow so as to replace a new magazine.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
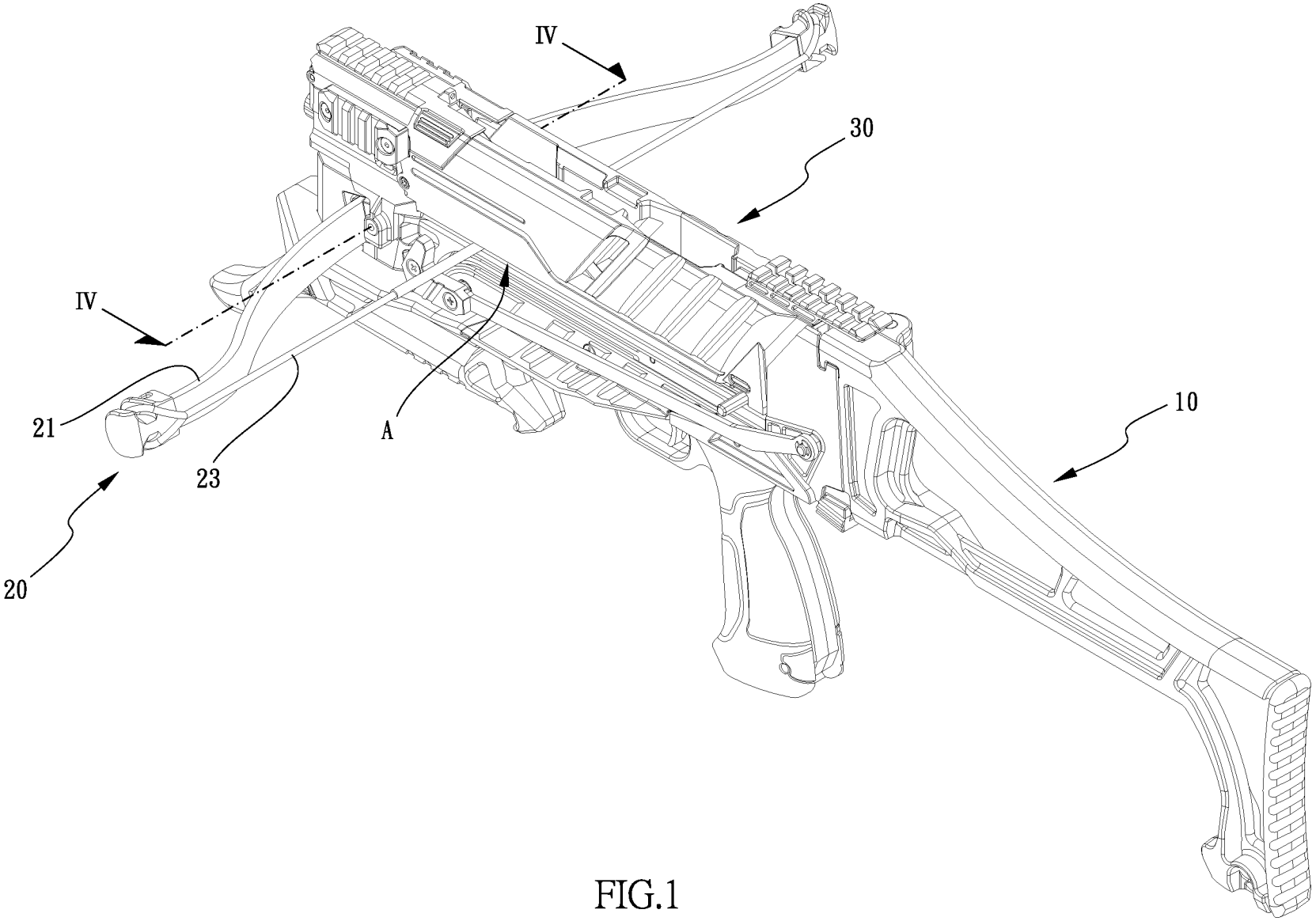
FIG. 1 is a perspective view to show the crossbow of the present invention.

Referring to FIGS. 1 to 9, the crossbow of the present invention comprises a body 10 having a grip 101 and a connection end 102 respectively formed to two ends of the body 10. A connection part 11 is formed to the connection end 102 and includes a clamping portion 12 and a top portion 14, wherein the clamping portion 12 is formed with the top portion 14. The top portion 14 includes a guide face 142 firmed to the top thereof.

A bow unit 20 include a bow 21 and a block 22 which is formed to the middle portion of the bow 21. A string 23 is connected between two ends of the bow 21. The block 22 is detachably connected to the clamping portion 12 to transversely position the string 23 above the guide face 142.

A magazine 30 includes a mounting member 301 which is located corresponding to the clamping portion 12. The magazine 30 is detachably connected to the body 10 to form a room "A" between the guide face 142 and the magazine 30, so that the string 23 is movable along the room "A". The mounting member 301 is detachable relative to the clamping portion 12 so as to restrict the block 22 of the bow unit 20. The magazine 30 is secured to the body 10 by the mounting member 301.

Figure 2:
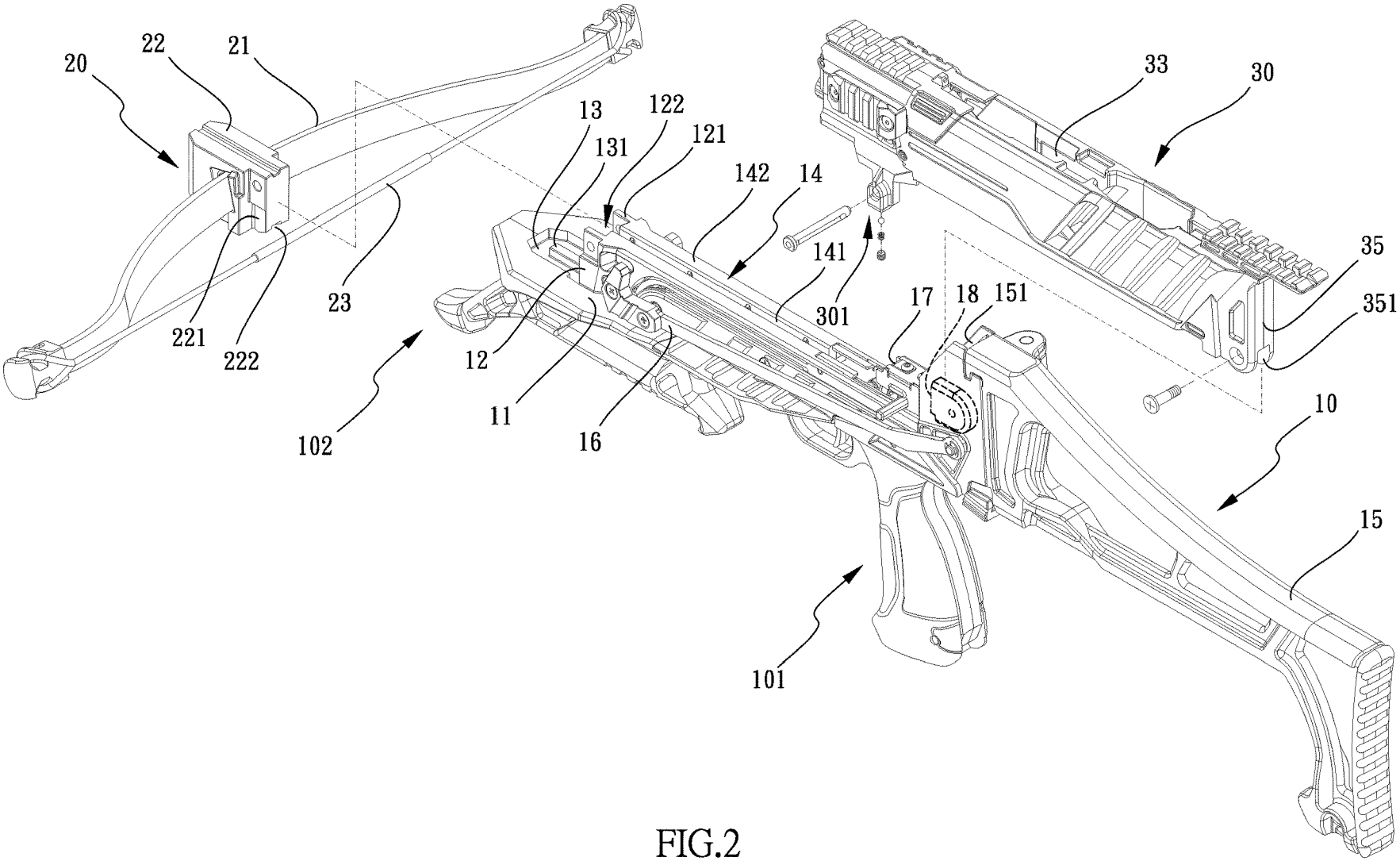
FIG. 2 is an exploded view of the crossbow of the present invention.

The bow unit 20 and the magazine 30 can be detachably connected to the body 10 of the crossbow so as to form the room "A" between the magazine 30 and the guide face 142 of the top portion 14. The mounting member 301 of the magazine 30 allows the magazine 30 to be detachably removed from the clamping portion 12 of the body 10. This is benefit to the user when loading arrows (not shown) to the magazine 30 while the heavy body 10 is not connected with the magazine 30 as shown in FIG. 2. The loaded magazine 30 can be quickly and easily connected to the body 10.

The mounting member 301 includes two lugs 31 extending toward the connection part 11. The clamping portion 12 is located between the two lugs 31. The clamping portion 12 includes two side plates 121, and a space 122 is formed between the two side plates 121. The block 22 includes a protrusion 221 which is located between the two side plates 121. A pin 32 movably extends through the two lugs 31, the two side plates 121 and the protrusion 221 to secure the magazine 30 and the bow unit 20 to the body 10. When the pin 32 is pulled off from the two side plates and the protrusion 221, the magazine 30 and the bow unit 20 are released.

Figure 3:
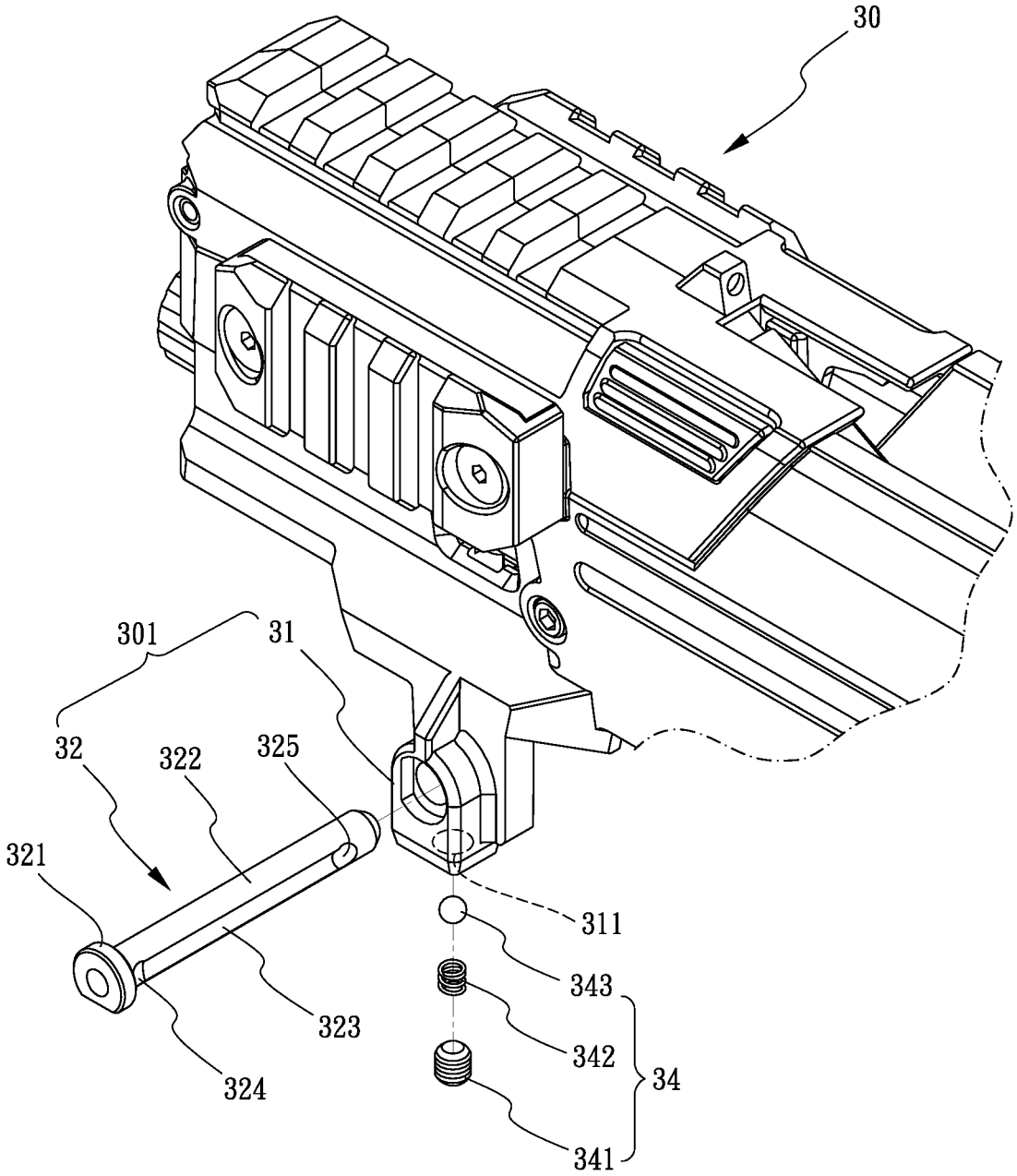
FIG. 3 shows the pin, the mounting member of the magazine and the positioning unit of the crossbow of the present invention.
Figure 4:
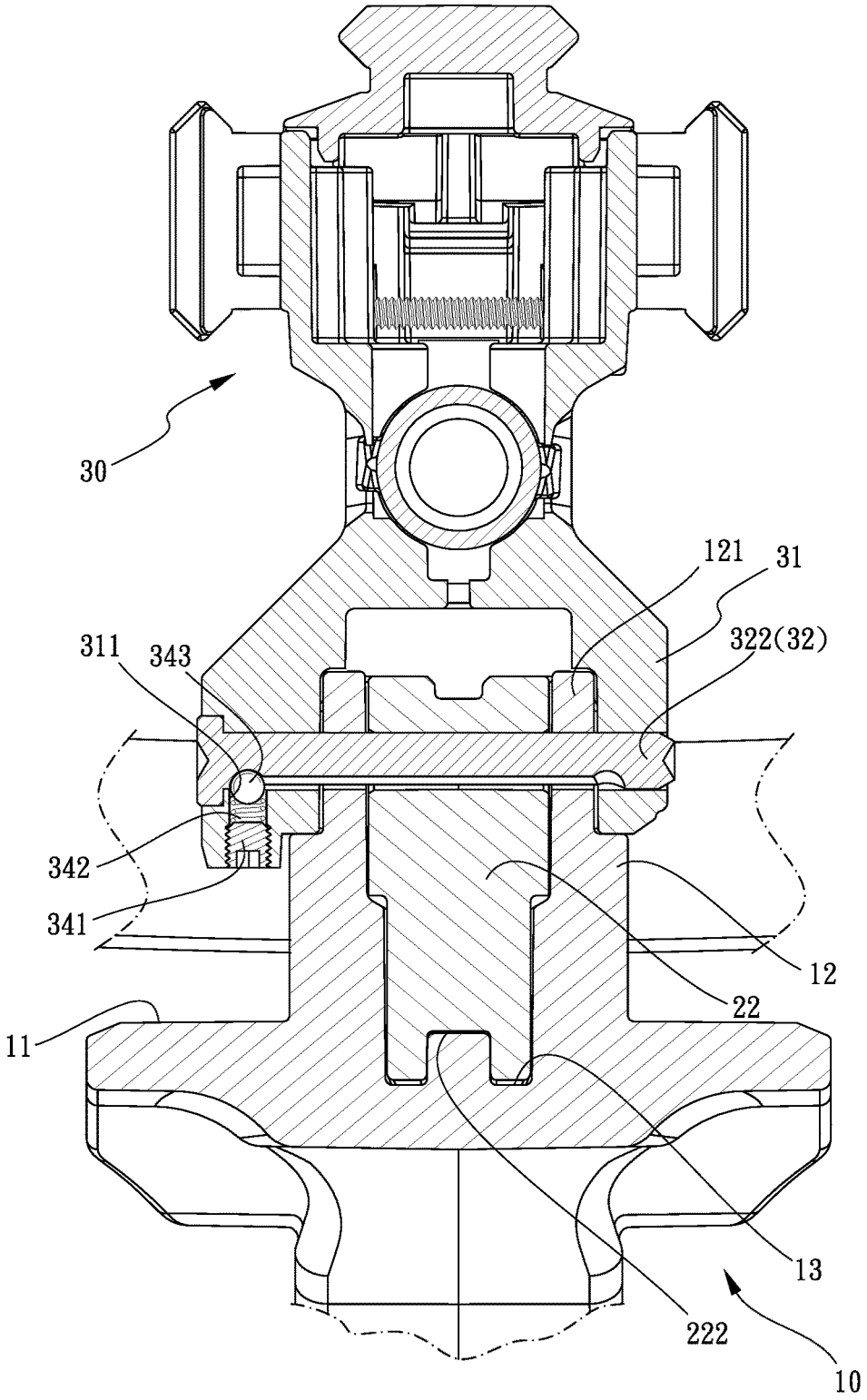
FIG. 4 is a cross sectional view, taken along line IV-IV in FIG. 1.
Figure 5:
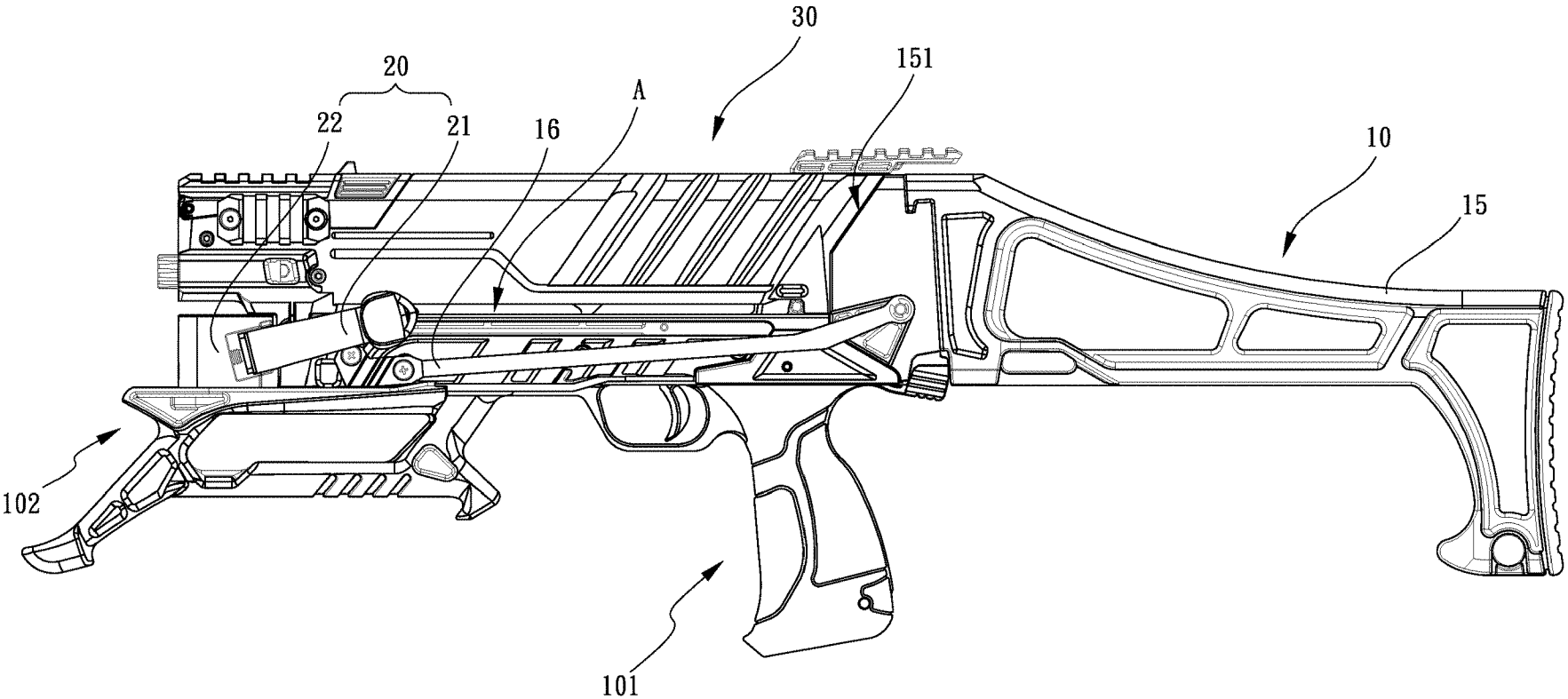
FIG. 5 is a side view of the crossbow of the present invention.
Figure 6:
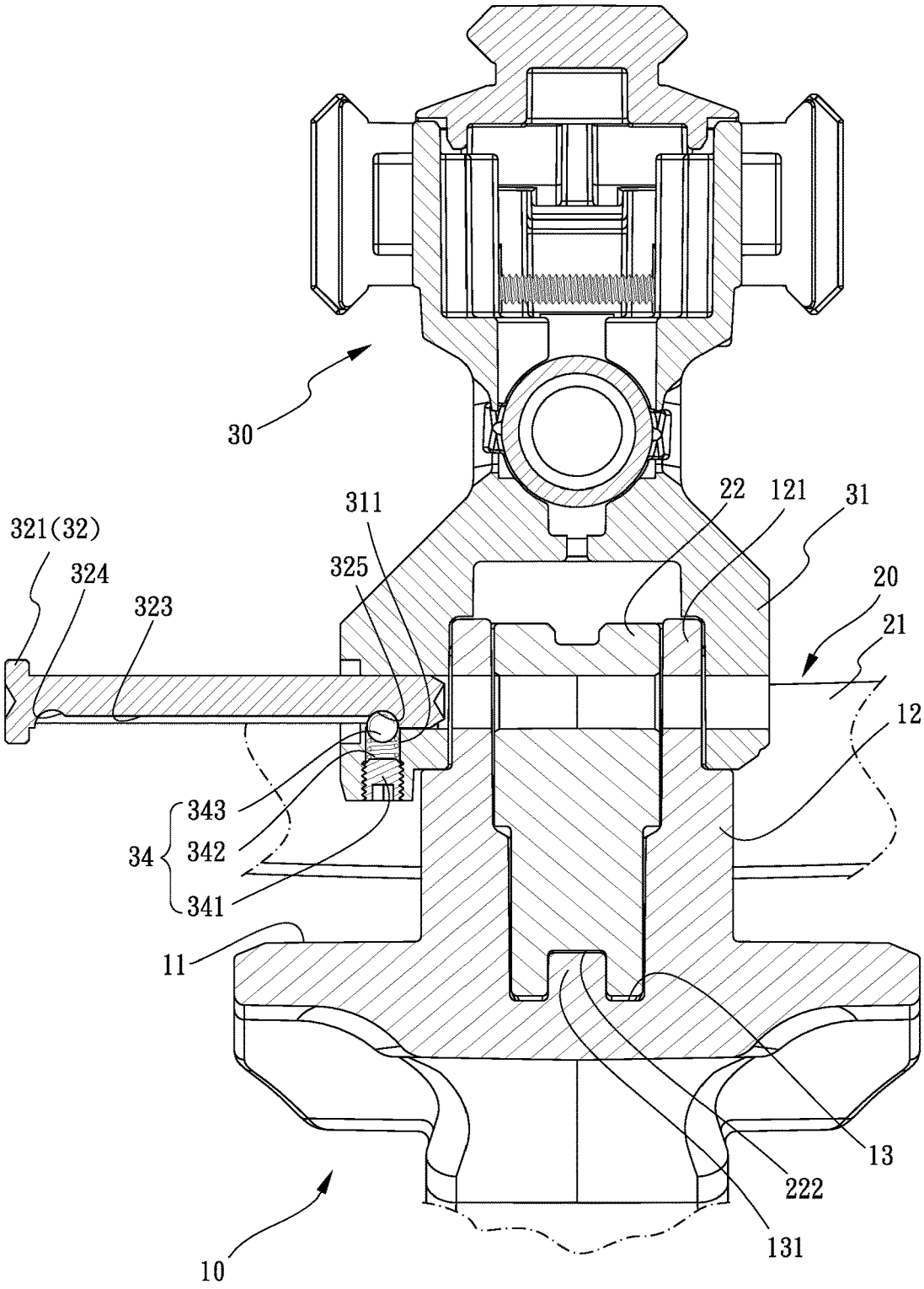
FIG. 6 shows that the pin is pulled from the clamping portion and the protrusion of the bow unit.
Figure 7:
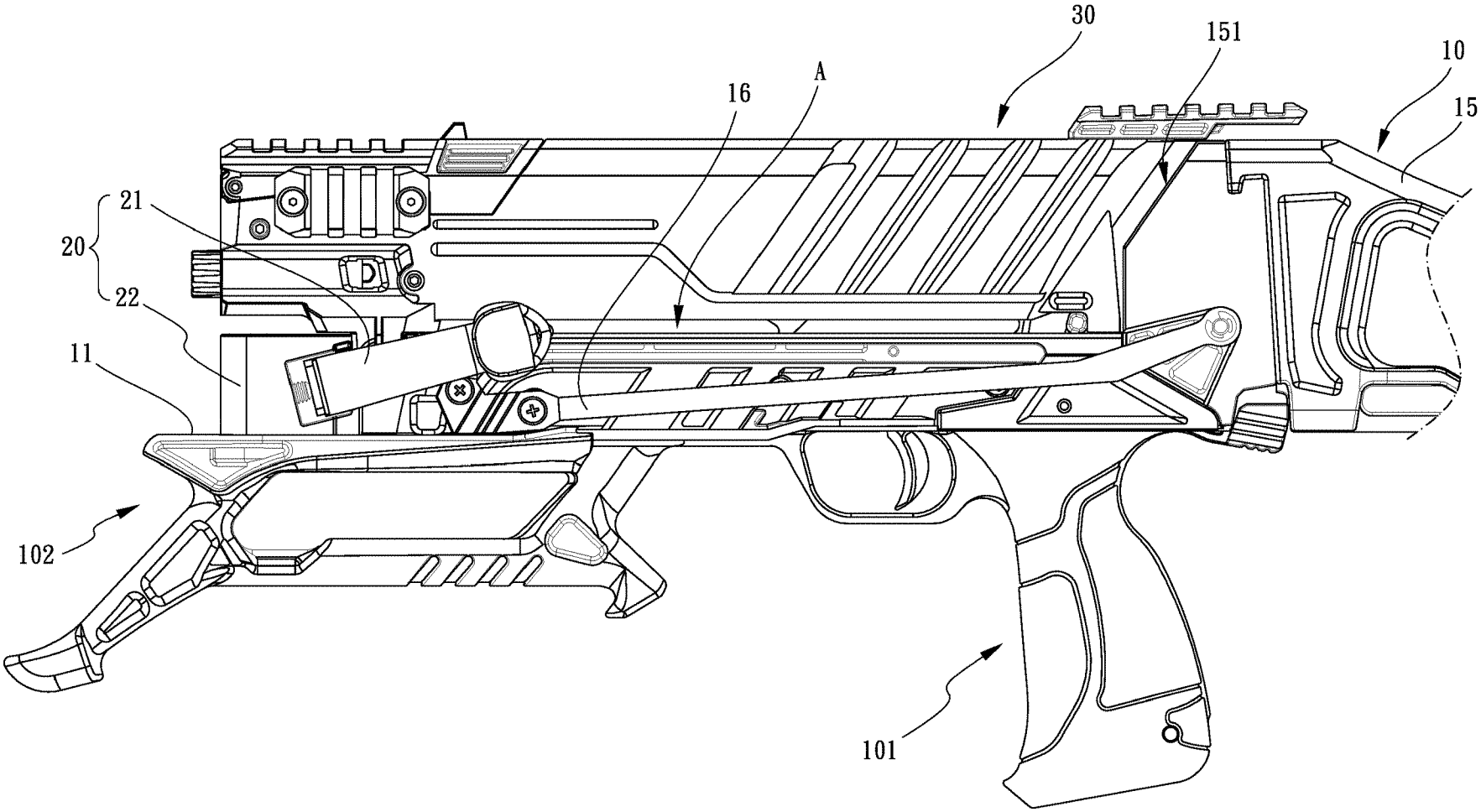
FIG. 7 is an enlarged view of the disclosure in FIG. 5.
Figure 8:
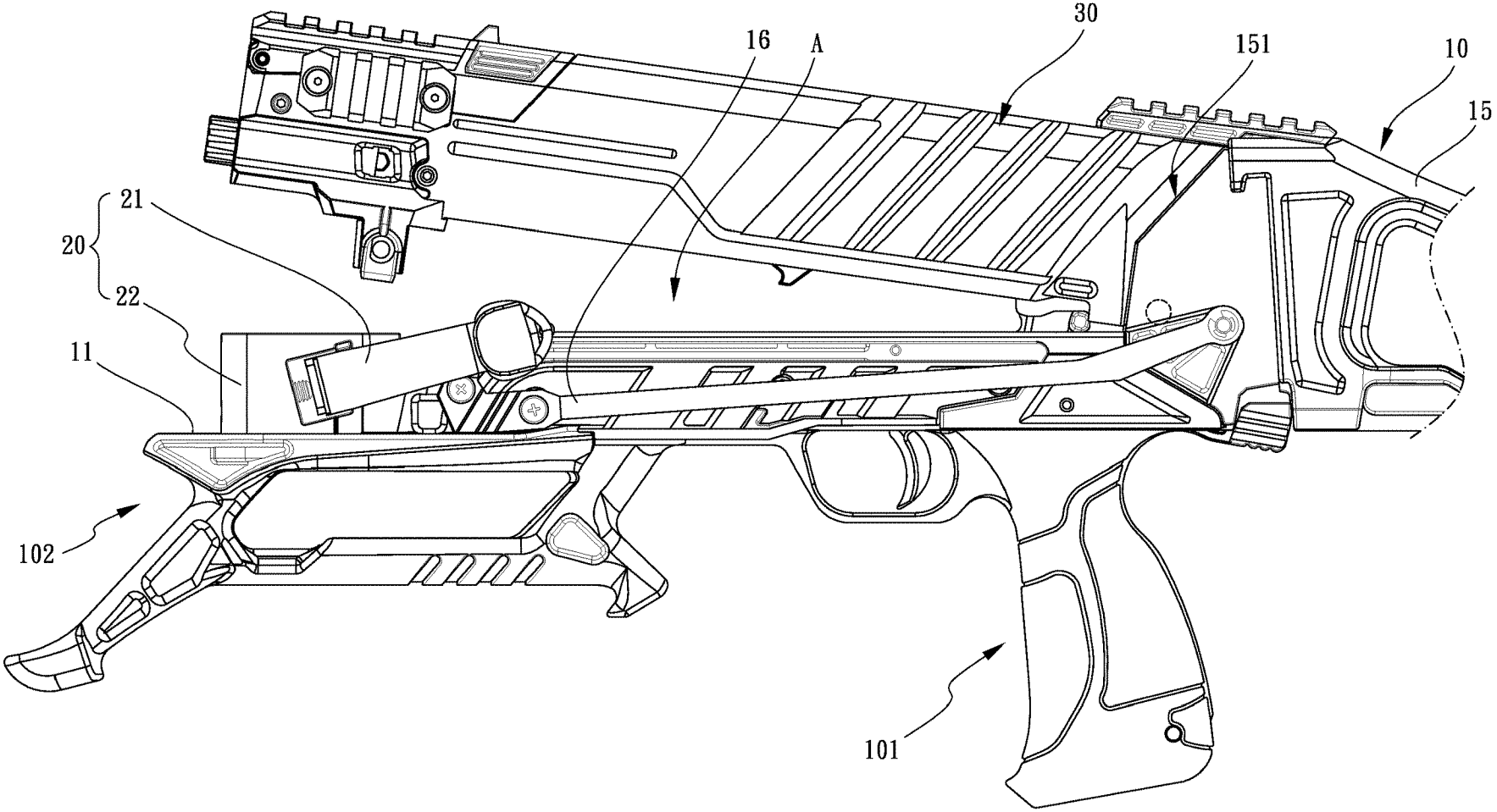
FIG. 8 shows that the magazine is pivoted away the body so as to release the bow unit.
Figure 9:
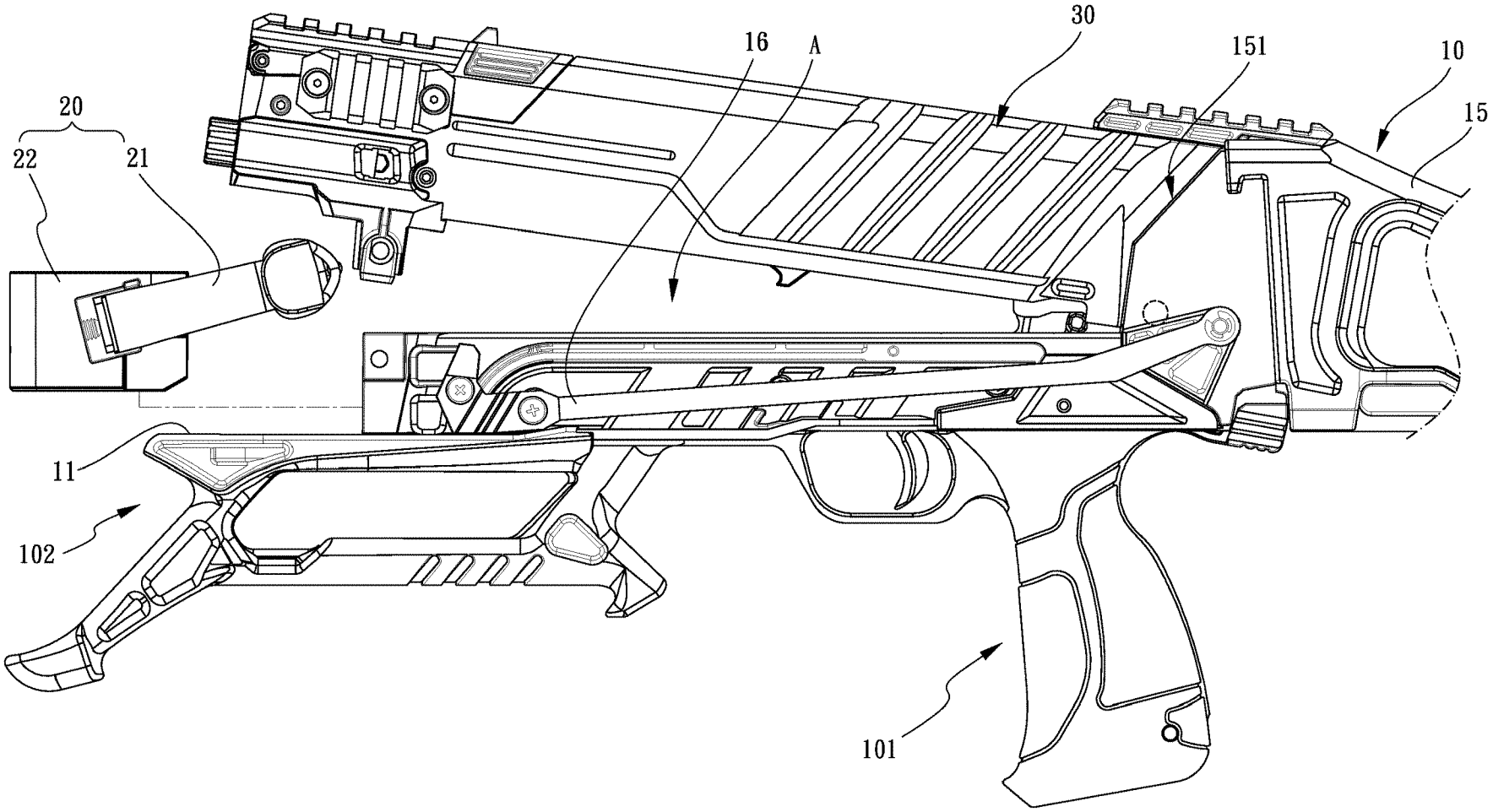
FIG. 9 shows that the bow unit is separated from the body of the crossbow of the present invention.

As shown in FIGS. 3, 4 and 6, the pin 32 includes a head 321 and a shank 322 which is formed with the head 321. The shank 322 includes a positioning groove 323 formed axially therein. A first dent 324, and a second dent 325 are respectively formed to the shank 322, and two ends of the positioning groove 323 communicate with the first and second dents 324, 325 respectively.

As shown in FIGS. 3, 4 and 6, one of the two lugs 31 includes a hole 311 which is located corresponding to the positioning groove 323 of the pin 32. The mounting member 301 includes a positioning unit 34 which is located in the hole 311 and includes a screw 341, a spring 342 and a ball 343. The screw 341 is threadedly connected to the hole 311 to prevent the spring 342 and the ball 343 from dropping from the hole 311. The spring 342 is biased between the screw 341 and the ball 343. The ball 343 is engaged with the positioning groove 323 of the pin 32 to restrict the pin 32 from dropping from the lugs 31. The pin 32 is positioned as shown in FIG. 4 when the pin 32 extends through the two lugs 31, the two side plates 121 and the protrusion 221 by engaging the ball 343 with the first dent 324. As shown in FIG. 6, when the pin 32 pulls off from the protrusion 221 of the block 22 and the two side plates 121 and one of the two lugs 31 to release the bow unit 20 and the magazine 30, the pin 32 is positioned by engaging the ball 343 with the second dent 325.

As shown in FIGS. 2 and 6, the body 10 includes a slot 13 defined through the connection part 11. A tongue 131 protrudes from the inner end of the slot 13. The block 22 is partially located in the slot 13 and includes a recess 222 defined in the underside thereof. The tongue 131 is engaged with the recess 222 to reinforce the connection between the bow unit 20 and the body 10.

The magazine 30 includes a path 33 defined therethrough, and the path 33 is located corresponding to the guide face 142. The top portion 14 includes a flight groove 141 defined in the guide face 142. Arrows (not shown) are loaded in the magazine 30 via the path 33.

The body 10 includes an adjustable stock 15 located close to the grip 101. The adjustable stock 15 includes a space 151 which includes an opening facing the top portion 14. A latch 17 and a rib 18 respectively protrude from the top portion 14. The rib 18 is located in the space 151 of the adjustable stock 15. The magazine 30 includes an end part 35 which includes a notch 351 communicating with the path 33. The end part 35 is located in the space 151 when the magazine 30 is connected to the body 10. The rib 18 is engaged with the notch 351 so as to reinforce the connection between the magazine 30 and the body 10.

The body 10 includes two hooks 16 pivotably connected to the adjustable stock 15. When the adjustable stock 15 is pivotable relative to the body 10, the two hooks 16 pull the string 23 which is cocked to the latch 17. The string 23 is released to shoot the arrow by pulling the trigger of the body 10.

The magazine 30 and the bow unit 20 can be released from the body 10 so that the user simply loads the arrows to the magazine 30 while the magazine 30 is separated from the body 10.

While we have shown and described the embodiment in accordance with the present invention, it should be clear to those skilled in the art that further embodiments may be made without departing from the scope of the present invention.

What is claimed is:

1. A crossbow comprising:

a body having a grip and a connection end respectively formed to two ends of the body, a connection part formed to the connection end and including a clamping portion and a top portion, the clamping portion formed with the top portion, the top portion including a guide face firmed to atop thereof;

a bow unit including a bow and a block which is formed to a middle portion of the bow, a string connected between two ends of the bow, the block detachably connected to the clamping portion to transversely position the string above the guide face, and a magazine having a mounting member at a first end thereof, the mounting member located corresponding to the clamping portion, a second end of the magazine detachably connected to the body, a room formed between the guide face and the magazine, the mounting member detachably combined with the clamp portion to restrict the block, a combination of the bow unit, the magazine and body being secured by the mounting member, wherein when the magazine is released from the clamp portion by the mounting member, the magazine is pivotable about the second end of the magazine, the first end of the magazine is located away from the clamping portion, so that the magazine is pivoted relative to the body, and the bow unit is detached from the clamping portion.

2. The crossbow as claimed in claim 1, wherein the mounting member includes two lugs extending toward the connection part, the clamping portion is located between the two lugs, the clamping portion includes two side plates, a space is formed between the two side plates, the block includes a protrusion which is located between the two side plates, a pin movably extends through the two lugs, the two side plates and the protrusion to secure the magazine and the bow unit to the body, when the pin is pulled off from the two side plates and the protrusion, the magazine and the bow unit are released.

3. The crossbow as claimed in claim 2, wherein the pin includes a head and a shank which is formed with the head, the shank includes a positioning groove formed axially therein, a first dent, and a second dent are respectively formed to the shank, two ends of the positioning groove communicate with the first and second dents respectively.

4. The crossbow as claimed in claim 3, wherein the one of the two lugs includes a hole which is located corresponding to the positioning groove of the pin, the mounting member includes a positioning unit which is located in the hole and includes a screw, a spring and a ball, the screw is threadedly connected to the hole, the spring is biased between the screw and the ball, the ball is engaged with the positioning groove of the pin to restrict the pin from dropping from the lugs.

5. The crossbow as claimed in claim 1, wherein the body includes a slot defined through the connection part, a tongue protrudes from an inner end of the slot, the block partially located in the slot and includes a recess defined in an underside thereof, the tongue is engaged with the recess.

6. The crossbow as claimed in claim 1, wherein the magazine includes a path defined therethrough, the path is located corresponding to the guide face, the top portion includes a flight groove defined in the guide face.

7. The crossbow as claimed in claim 6, wherein the body includes an adjustable stock located close to the grip, the adjustable stock includes a space which includes an opening facing the top portion, a latch and a rib respectively protrude from the top portion, the rib is located in the space of the adjustable stock, the magazine includes an end part which includes a notch communicating with the path, the end part is located in the space when the magazine is connected to the body, the rib is engaged with the notch.

8. The crossbow as claimed in claim 7, wherein the body includes two hooks pivotably connected to the adjustable stock, when the adjustable stock is pivotable relative to the body, the two hooks pull the string which is cocked to the latch.

* * * * *